United States Patent [19]

Steiner

[11] 3,966,047

[45] June 29, 1976

[54] PAPER CURRENCY ACCEPTOR

[75] Inventor: Larry E. Steiner, Grand Rapids, Mich.

[73] Assignee: Rowe International Inc., Whippany, N.J.

[22] Filed: Nov. 27, 1974

[21] Appl. No.: 526,941

[52] U.S. Cl. ..... 209/75; 209/111.8; 209/DIG. 2; 324/34 R; 235/61.11 K

[51] Int. Cl.[2] ..... B07C 5/344

[58] Field of Search ..... 209/111.8, 111.7, 75, 209/DIG. 2; 324/34 R; 235/61.11 K; 250/556

[56] References Cited

UNITED STATES PATENTS 3,293,543 12/1966 Nelson et al. ..... 209/111.8 X 3,706,374 12/1972 Ptacek ..... 209/DIG. 2

*Primary Examiner*—Allen N. Knowles

*Attorney, Agent, or Firm*—Shenier & O'Connor

[57] ABSTRACT

A paper currency acceptor which performs a first magnetic test on a first predetermined area of a bill corresponding to an area of a genuine bill printed with magnetic ink to produce a credit signal in response to a genuine bill and to reject a spurious bill not printed with magnetic ink in the first area and which performs a second magnetic test on a second printed area of the bill corresponding to an area of a genuine bill printed with nonmagnetic ink to reject a spurious bill made on a copying apparatus employing magnetic toner particles.

14 Claims, 2 Drawing Figures

FWD.
REV.
TO 78
A
B
P6
P4
P1
+5V
(A)
(B)

PAPER CURRENCY ACCEPTOR

BACKGROUND OF THE INVENTION

There are known in the prior art dollar bill collectors which make use of the fact that bills such as genuine United States one dollar bills are printed in part with magnetic ink. One such collector is shown and described in Hooker U.S. Pat. No. 3485,358. In the arrangement illustrated in the Hooker patent, in the course of the passage of a bill through the collector and into a collection box, portrait areas of the bill are sensed by a magnetic head to provide a signal indicating that the bill is genuine so that credit can be given. In the event that no signal is produced by the magnetic head as it scans portrait areas of the bill the transport motor of the acceptor is reversed and the bill is returned to the customer. Various attempts have been made by dishonest persons to cheat the dollar bill acceptors to obtain credit or change by inserting a spurious bill in the apparatus. In order to counteract these attempts to cheat the machine various safety features have been incorporated therein. One such safety feature is incorporated in the apparatus shown and described in Okkonen U.S. Pat. No. 3,715,031.

There are also known in the prior art duplicating machines which employ toner particles having magnetic properties to develop a latent image. It is of course desirable that a person who makes a copy of a genuine bill on such a machine not be able to cheat a dollar bill acceptor which at least in part relies on a magnetic test to determine the genuineness of a bill. I have invented an improved paper currency acceptor which will not establish credit in response to the insertion therein of a copy of a genuine dollar bill made on an apparatus employing toner particles having magnetic properties. My apparatus is relatively simple in construction for the result achieved thereby. It is certain in operation.

SUMMARY OF THE INVENTION

One object of my invention is to provide a paper currency acceptor which rejects a spurious copy of a genuine dollar bill made on a copying apparatus employing toner particles having magnetic properties.

A further object of my invention is to provide an improved paper currency acceptor which is certain in operation.

Another object of my invention is to provide an improved paper currency acceptor which is relatively simple in construction.

Other and further objects of my invention will appear from the following description.

In general my invention contemplates the provision of an improved paper currency acceptor in which a magnetic scanning head scans areas of the bill corresponding to areas of a genuine bill printed with magnetic ink to produce a signal indicating that the bill is acceptable and which also scans other areas of the bill corresponding to areas of a genuine bill printed with nonmagnetic ink to produce a second signal indicating that while the bill passed the first magnetic test it failed the second and should be rejected.

DESCRIPTION OF THE PREFERRED EMBODIMENT

Figure 1:
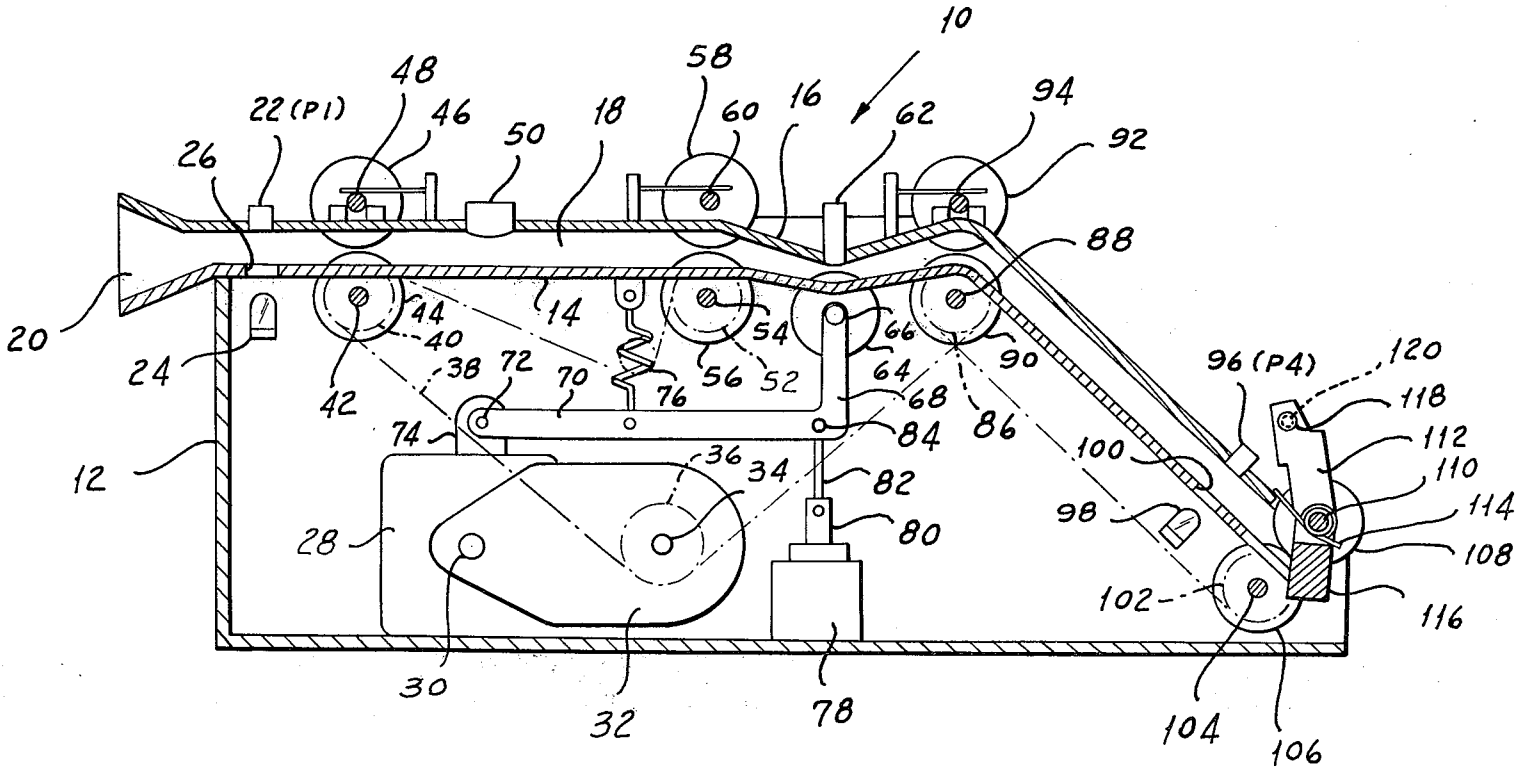
FIG. 1 is a sectional view of my improved bill acceptor for rejecting copies of a genuine bill made on a copying apparatus employing toner particles having magnetic properties.

Referring now to FIG. 1 of the drawings, my improved bill acceptor indicated generally by the reference character 10 includes a housing 12 carrying spaced lower and upper guides 14 and 16 forming a passage 18 into which a bill is adapted to be introduced through a mouth 20 at the left end of the passage as viewed in the figure. A photocell 22 mounted in the upper guide 16 normally is illuminated by means of a lamp 24 casting light through an opening 26 in the lower guide 14. As will be more fully explained hereinbelow, as a bill is introduced into the passage 18 through the mouth 20 it interrupts the light from lamp 24 falling on photocell 22 to energize a drive motor 28 to drive in a forward direction to rotate a shaft 30 providing the input to a gear box 32. The gear box 32 has an output shaft 34 carrying a sprocket wheel 36 which drives a pitch chain 38.

Chain 38 extends to a sprocket wheel 40 carried by a shaft 42 supported on the housing 12. Shaft 42 carries a number of spaced transport wheels 44 adapted to cooperate with upper idler wheels 46 carried by a shaft 48. As the bill enters into the nip between the wheels 44 and 46 it is carried along the passage 18 from left to right as viewed in FIG. 1. For proper operation of the acceptor the bill must be inserted face up with the potrait facing in the direction of movement of the bill. In the course of its movement along the passage 18 the bill passes under a magnet 50 supported in the upper guide so that portions of the bill printed with magnetic ink are magnetized.

Chain 38 extends around a sprocket wheel 52 carried by a shaft 54 supporting a number of spaced lower intermediate transport wheels 56. Wheels 56 cooperate with upper idler wheels 58 carried by a shaft 60 to continue the movement of the bill along the passage 18. As the bill moves along the passage past the wheels 56 and 58, areas thereof are scanned by a magnetic pick-up head 62. It will readily be appreciated that the head 62 is made sufficiently wide so that correct predetermined regions of the bill are scanned. In my bill acceptor I insure that the head sequentially scans the left shoulder region and the right shoulder region and then the serial number region of the bill. A pressure roller 64 disposed below the head 62 is carried by a shaft 66 which is supported on one arm 68 of a bell crank having a second arm 70, the end of which is supported on a pivot pin 72 carried by a bracket 74 on the housing of motor 28. A spring 76 connected between the arm 70 and the lower guide 14 normally biases the lever arm to urge the pressure roller 64 upwardly into the passage 18 so as to press a bill firmly into engagement with the sensing head 62. A solenoid 78 has an armature 80 connected by a rod 82 to a pivot pin 84 on the lever arm 70. Solenoid 78 is adapted to be energized in a manner to be described hereinbelow to move the pressure roller 64 away from the head 62.

Chain 38 extends around a sprocket wheel 86 carried by a shaft 88 supported on the housing 12. Shaft 88 carries a plurality of spaced lower transport rollers which cooperate with upper idler rollers or wheels 92 carried by a shaft 94. As the bill leaves the wheels 90 and 92 it moves along a portion of the passage 18 extending downwardly and to the right as viewed in FIG. 1. A photocell 96 mounted in the upper guide 16 normally is illuminated by a lamp 98 which throws light through an opening 100 in the lower guide 14. As the leading edge of the bill arrives at the opening 100 it interrupts the light from lamp 98 to photocell 96.

Chain 38 also is coupled to a sprocket wheel 102 carried by a shaft 104 supported on housing 12 at the lower righthand end of guide 14. Shaft 104 carries a plurality of spaced transport wheels 106 which cooperate with idler wheels 108 carried by a shaft 110 at the lower righthand end of the upper guide 16.

Shaft 110 carries a lever arm 112 the lower end of which is disposed in the path of bill emerging from the nip between wheels 106 and 108. A spring 114 on shaft 110 is biased between the lower edge of the upper guide 16 and a boss 116 on the lever 112 normally to position the lower end of the lever in the path of the emerging bill. The upper end of the lever 112 normally is positioned in the space between a photocell 118 and a lamp 120. As the bill emerges from the nip between rollers 106 and 108 it activates the arm 112 to move the upper end thereof against the action of spring 114 out of the space between photocell 118 and lamp 120 so that light from the lamp is permitted the fall onto the photocell.

Figure 2:
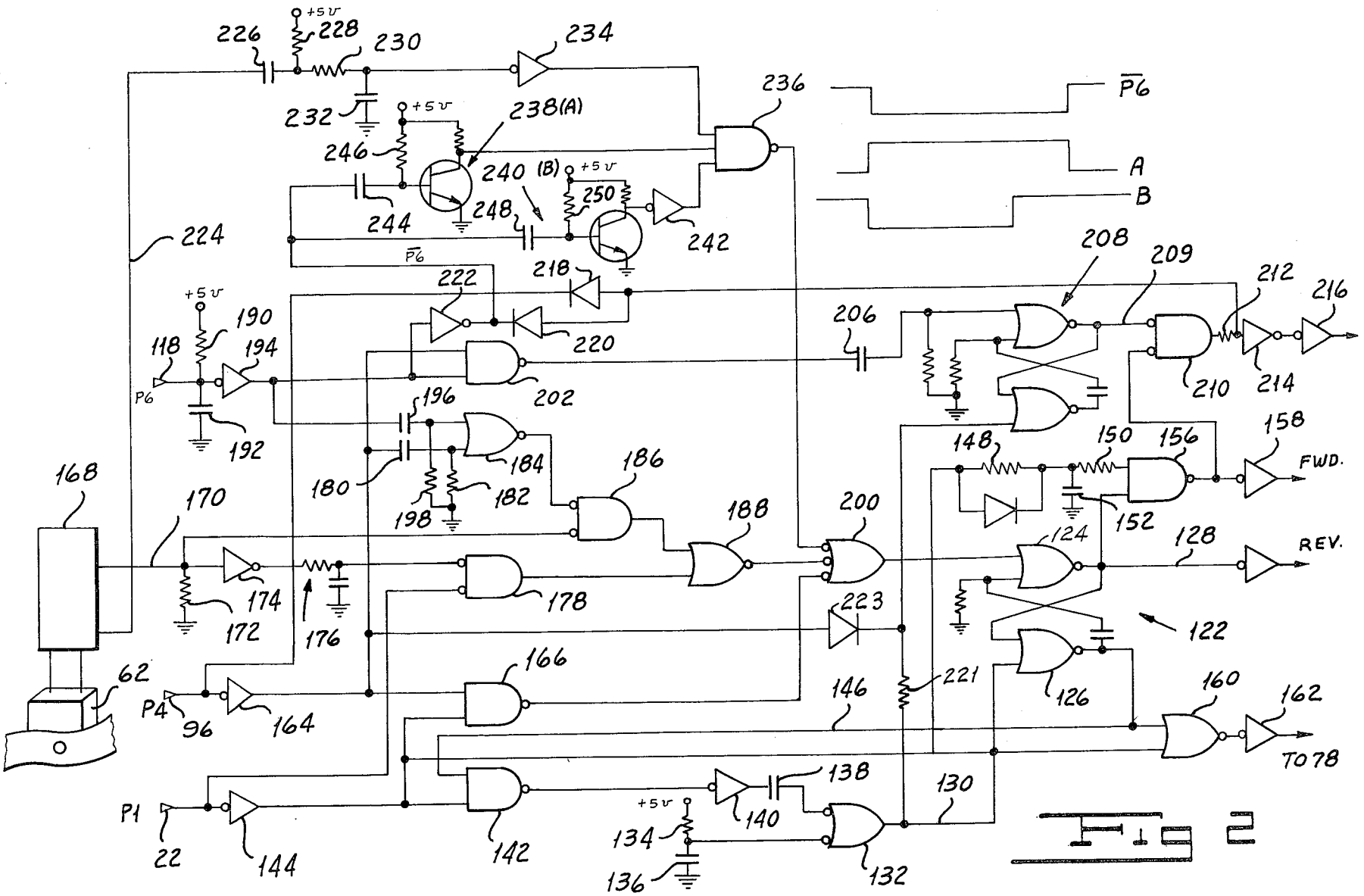
FIG. 2 is a schematic view of the electrical circuitry of my improved paper currency acceptor.

Referring now to FIG. 2, the electric circuit of my paper currency acceptor includes a motor control flip-flop indicated generally by the reference character 122, made up of a pair of NOR circuits 124 and 126. In the forward condition of the flip-flop 122, a conductor 128 carries a relatively high or "plus" potential. The flip-flop is set by an input line 130, which sets the flip-flop in the forward state when the line goes plus. Line 130 receives its signal from a two input NOR logic circuit 132, one input of which is supplied from the common terminal of a resistor 134 and capacitor 136 connected between a suitable source of potential of, for example, 5 volts and ground. The other input to the circuit 132 is coupled thereto by a capacitor 138 in the output circuit of an inverter 140. Inverter 140, in turn, receives its input from a two input NAND circuit 142, one input to which is provided by an inverter 144, which receives its input signal from the photocell 22 designated as P1 in FIG. 2. The other input to circuit 142 is provided by a line 146, which goes positive if the motor runs in reverse but which normally is at zero, or, relatively negative potential.

When the power is turned on, flip-flop 122 assumes the state in which line 128 is relatively positive, so that the flip-flop is set in the forward state. Under these conditions, when a bill is inserted in the acceptor photocell P1 is covered. As a result, the output of inverter 144 goes relatively positive. This signal is applied to a network including series connected resistors 148 and 150, a parallel capacitor 152 connected between the common terminal of the resistors in ground and a diode 154 across resistor 148. Thus a positive signal is applied to one input terminal of a two input logic NAND circuit 156, the other input of which is provided by line 128. Since this line is relatively plus, the output of circuit element 156 goes relatively negative and will remain so as long as the flip-flop 122 is set in the forward condition and an input is provided to the other terminal of circuit 156. The RC circuit 148 and 152 ensures that a signal remains at the other terminal of element 156 for a sufficiently long time to permit the motor to carry the bill entirely through the acceptor. An inverter 158 couples the output from circuit 156 to the forward control relay of the drive motor 28.

I also apply the output from inverter 144 to one input terminal of a two input NOR gate 160, the other input of which is provided by the output of gate 126 of the flip-flop 122. In response to these two signals, the output of element 160 goes relatively negative and the output of an inverter 162 in the output circuit of element 160 goes relatively positive and is applied to solenoid 78.

I couple the output of photocell P4 to the input of an inverter 164, which provides one input for a two input NAND logic element 166, the other input of which is provided by inverter 144. If both photocells P1 and P4 are covered at the same time, the outputs of both inverters 144 and 164 will be positive, so that the output of circuit 166 under these conditions will go relatively negative.

I connect the magnetic head 62 to a magnetic amplifier 168, which produces a positive-going signal on an output channel 170, when a magnetized area producing a particular frequency is detected by the head 62. A resistor 172 limits the magnitude of the signal on channel 170. When channel 170 goes positive, the output of an inverter 174 goes negative and this signal is passed through filter 176 to one input terminal of a NAND gate 178. Circuit 178 is so constructed that its output will go positive if the signals to both inputs thereof are relatively negative. The other input of this circuit is provided directly from the output of photocell P1. Thus, it will be seen that if a magnetic signal exists on channel 170 when the photocell P1 is covered, indicating a faulty magnetic amplifier 168, the output of circuit 178 goes relatively positive.

I apply the output of inverter 164 to an RC circuit including a capacitor 180 and a resistor 182, the common terminals of which provide one input to a NOR gate 184. The arrangement of circuit 184 is such that its output will go negative in response to a positive signal at either of its two input terminals. Thus, in response to the output of inverter 164, the output of circuit 184 will be a negative going pulse of a duration determined by the RC circuit 180 and 182. At the same time as circuit 184 is producing the negative going pulse resulting from covering of the P4 photocell, the head 62 is reading what should be a magnetized region of the bill. If at this time a magnetic signal of the proper frequency is being detected, line 170 goes relatively positive. This signal is supplied to one input of a two-input NOR gate 186, the other input of which is provided by circuit 184. Circuit 184 is so constructed that its output will go positive only if both inputs thereto are negative. I so arrange my system that, where a genuine bill is passing through the acceptor, the positive going signal produced on line 170 as the P4 signal is being generated in the output of circuit 184 is of greater duration than the P4 signal. That is to say, it begins earlier in time and ends later in time. Thus, where a genuine bill is passing through the system, the output of circuit 186 will not go positive during the P4 test. Conversely, if no magnetic signal is produced during the P4 pulse, the output of circuit 186 will go positive during the P4 pulse. I apply the output of circuit 186, as well as the output of circuit 178 to a two input NOR gate 188, so arranged that the output will go negative if either of the two inputs thereto are positive.

As is pointed out more fully in the Hooker patent referred to hereinabove, a second magnetic test is performed at the time the photocell P6 is uncovered. The common terminal of an RC circuit including resistor 190 and capacitor 192 connected between a suitable source of potential and ground, normally holds the input to an inverter 194 positive, so that the output is relatively negative. When, however, the photocell P6 is uncovered, the output of inverter 194 goes relatively positive. We apply this signal to an RC circuit, including a capacitor 196 and a resistor 198, the common terminal of which provides a second input for circuit element 184. The result is a negative going pulse in the output of circuit 184, the duration of which pulse is determined by the parameters of the RC circuit. At the time this P6 pulse is being generated, when a genuine bill is passing through the acceptor, channel 170 should carry a positive going pulse which begins prior to and ends later than does the P6 pulse. Under these conditions, the output of circuit 186 will not go positive.

We couple the output of each of the circuits 166 and 188 to two input terminals of a three input NOR gate 200, the output of which goes relatively positive if anyone of the inputs thereto goes relatively negative. It will thus be seen that circuit 166 will produce a positive signal in the output of circuit 200 if both P1 and P4 are covered at the same time. Similarly, the output of circuit 188 will result in a positive going output in circuit 200, if the bill passing through the acceptor fails either the P4 or P6 test. We apply the output of circuit 200 to circuit element 124 of flip-flop 122 to reverse the motor if any of the conditions just described occur.

I also couple the output of inverter 194 to one input of a two input NAND circuit 202, which receives its other input from inverter 164. When both inputs to circuit 202 are positive, the output goes relatively negative, indicating the P4 is covered and P6 is uncovered. At the time at which P4 is uncovered as the trailing edge of the bill passes by, the output of circuit 202 goes relatively positive to set the credit. A capacitor couples this signal to the credit flip-flop indicated generally by the reference character 208, so that the output thereof on line 209 goes relatively negative. I couple the output of flip-flop 208, together with the output signal from circuit 156 to the input to a two input NAND circuit 210, the output of which goes relatively positive when both inputs thereto go to zero. A resistor 212 couples this signal to a first inverter 214, which supplies a second inverter 216 to provide the credit pulse. A diode 218 couples the input to inverter 214 to the P4 output. The line leading to the P4 output goes negative when P4 is covered insuring that P4 must be uncovered for the unit to give proper credit. Another diode 220 connects the input to inverter 214 to the output terminal of an inverter 222. Inverter 194 supplies the input to inverter 222. The line from resistor 212 to diode 220 goes negative when P6 is uncovered and insures that the bill must be passed element 116 in order for the unit to give credit. A resistor 221 applies the output of NOR gate 132 to a reset input to flip-flop 208. A diode 223 couples inverter 164 to the same input.

I provide my acceptor which means for rejecting a spurious bill which is printed entirely with magnetic ink rather than with magnetic ink only in certain areas thereof as in the case of a genuine bill. First, I take an output from the magnetic amplifier 168 on a line 224 connected into the amplifier ahead of the frequency filter section thereof (not shown), so that all magnetic signals generated by the bill will be present on conductor 224, rather than just those of a selected frequency. Signals appearing on line 224 are filtered and attenuated by an arrangement of a capacitor 226, resistor 228 connected to a suitable source of potential, a resistor 230 and a parallel capacitor 234. The signal from the amplifier 168 on line 224 when a magnetic area is sensed is a zero-going pulse from a normal potential of about 16 volts DC. The resultant signal is fed by an inverter 234 to one input terminal of a three input NAND circuit 236, the output of which is adapted to go low or relatively negative in response to a high or relatively positive signals at all three of its input terminals.

My magnetic copy detection circuit further includes two transistor timer circuits indicated generally respectively by the reference characters 238 and 240. I apply the outputs of these two circuits respectively to the other two input terminals of the NAND circuit 236. Inverter 222 provides the input to the transistor timer circuits 238 and 240. So long as the photocell P6 is covered, the output of inverter 222 is high or relatively positive. When, however, the photocell P6 is uncovered, the inverter output goes relatively negative. As a result of this input signal, each of the timers 238 and 240 puts out a positive going signal, the duration of which is determined by the time constants of the particular circuit. I apply the output of timer 238 directly to one input terminal of the circuit 236. An inverter 242 applies the output of circuit 240 to the circuit 236.

By way of example, I have indicated the relationship between the input to the timer circuits and the outputs thereof in the upper right hand corner of FIG. 2. As will be seen, two of the inputs to the circuits 236 are relatively positive for a short period of time, the "enable time" before the trailing edge of the bill permits P6 again to be covered. If during this period of time head 26 detects a magnetic area, line 224 will carry a signal in the form of a zero going pulse, which is inverted by inverter 234 and applied to the third input of circuit 236, so that the output of this circuit goes to zero if a magnetic area is detected during the enabling time. This output is applied to circuit 200 to cause the motor drive to be reversed in the event of detection of a magnetic area where none should exist.

More specifically, an RC circuit including a resistor 246 and a capacitor 244 controls the operation of transistor timer 238 while a capacitor 248 and resistor 250 control the operation of the timer 240. When the output of inverter 222 goes to zero or relatively negative that is, the capacitor 244 begins to charges through resistor 246 and capacitor 248 begins to charge through resistor 250. In one particular embodiment of my circuit, both of the capacitors 244 and 248 may have a capacitance of about 0.1 ufd, while resistors 246 and 150 have respective resistance of 2.2 megohms and 820,000 ohms. As a result, the time required to switch the resistor of circuit 240 on, is less than that required to turn the transistor of circuit 238 on.

I so choose the parameters of the timer 240, as to "time out" to turn its transistor on when the magnetic head 62 is approaching the Serial No. and Federal Reserve seal areas of a United States dollar bill, for example. On a genuine United States dollar bill, there are no magnetic properties in this area. If, however, a spurious bill has been made using a magnetic ink, when the head 62 scans this area, the corresponding input to the gate 236 goes relatively positive and the motor reverses.

In operation of my improved bill acceptor for rejecting copies of genuine bills made on a copying apparatus employing magnetic toner, a bill inserted into the mouth 20 of the passage 18 interrupts the light from lamp 24 to photocell 22 to cause the transport motor 38 to begin to drive in the forward direction. As the bill moves along the passage 18, it passes under magnet 50 so that portions thereof printed with magnetic ink are magnetized. Next, the bill passes under the sensing head 62. As a first portion of the portrait passes under the head, the leading edge of the bill interrupts light from lamp 98 to photocell 96. So long as the first magnetic pulse coincides with the pulse resulting from the interruption of light to photocell 96, the bill continues to be driven in a forward direction. Next, photocell 118 is uncovered and at the same time a second area of the portrait is scanned. So long as the pulse resulting from scanning of the second magnetic area coincides with the pulse produced by the uncovering of photocell 118, the bill continues to travel forward.

Finally, an area of the bill corresponding to an area of a genuine bill printed with other than magnetic ink passes under the head 62. So long as the area being sensed by the head at this time is not printed with magnetic material, the bill continues to travel forward, is accepted, and a credit signal is given. If, however, the area being sensed by the bill at this time is printed with magnetic material, as would occur when a copy of a genuine bill is made on a copier using magnetic toner particles, amplifier 168 puts out a signal on line 224 with the result that the output of NAND circuit 236 drops to ground so that the drive motor is reversed and no credit signal is given.

It will be seen that I have accomplished the objects of my invention. I have provided an improved bill acceptor which rejects copies of genuine bills made on a copying apparatus employing magnetic toner particles. My improvement is applicable to existing bill acceptors. It is relatively simple and inexpensive for the result achieved thereby.

It will be understood that certain features and subcombinations are of utility and may be employed without reference to other features and subcombinations. This is contemplated by and is within the scope of our claims. It is further obvious that various changes may be made in details within the scope of our claims without departing from the spirit of our invention. It is, therefore, to be understood that our invention is not to be limited to the specific details shown and described.

Having thus described our invention, what we claim is:

1. A bill acceptor for rejecting a spurious bill having magnetic material in an area where genuine bills are printed with nonmagnetic ink and including in combination a high resolution magnetic sensing head, means including said sensing head for scanning the bill along a path traversing said area, means for producing a signal concurrent with the traversal of said area by the sensing head, said head providing an output pulse for each transition from a nonmagnetic region of the bill to a magnetic region thereof, and means responsive to the concomitant presence of said signal and a single output pulse from the magnetic sensing head for rejecting the bill.

2. A bill acceptor as in claim 1 in which said scanning means comprises means for moving the bill and in which said signal producing means includes means responsive to the leading edge of the bill.

3. A bill acceptor as in claim 1 in which said scanning means comprises means forming a passage having an entrance and an exit and means including a reversible drive motor for moving the bill along the passage from the entrance toward the exit and in which said rejecting means comprises means for reversing said motor.

4. A bill acceptor as in claim 1 in which said scanning means comprises means forming a passage having an entrance and an exit and means including a reversible drive motor for moving the bill along said passage from the entrance toward the exit, in which the signal producing means includes means responsive to the leading edge of the bill, and in which the rejecting means comprises means for reversing the motor.

5. A bill acceptor including in combination, means for receiving a bill to be tested for genuineness, magnetic scanning means for producing a first signal in response to the presence adjacent thereto of a first portion of said bill carrying magnetic material and for producing a second signal in response to the presence adjacent thereto of a second portion of said bill carrying magnetic material, means for producing a third signal corresponding in time to the time of location of said first portion of said bill adjacent to said scanning means, means for producing a fourth signal corresponding in time to the time of location of said second portion of said bill adjacent to said scanning means, means responsive to the concomitant presence of said third signal and absence of said first signal for producing a first spurious bill signal, and means responsive to the concomitant presence of said second and fourth signals for producing a second spurious bill signal.

6. A bill acceptor as in claim 5 including means responsive to a spurious bill signal for rejecting said bill.

7. A bill acceptor as in claim 5 in which said third pulse occurs before said fourth pulse.

8. A bill acceptor as in claim 5 in which said first bill portion corresponds to a first area of a genuine bill printed with magnetic ink and in which said second bill portion corresponds to a second area of a genuine bill printed with nonmagnetic ink.

9. A bill acceptor as in claim 5 in which said bill receiving means comprises means forming a passage having an entrance and an exit, and in which said scanning means comprises a magnetic head located adjacent to said passage and a reversible drive motor for moving a bill along said passage in a direction from said entrance to said exit past said head, said acceptor including means responsive to a spurious bill signal for reversing said motor.

10. A bill acceptor as in claim 5 in which said receiving means comprises means forming a passage having an entrance and an exit, in which said scanning means comprises a magnet located adjacent to said passage and means for moving said bill along said passage in a direction from said entrance toward said exit, in which said means for producing said third signal comprises means responsive to the leading edge of a bill moving along said passage and in which said means for producing said fourth signal comprises means responsive to said third signal.

11. A bill acceptor as in claim 10 in which said means responsive to said third signal comprises means for producing respective pulses of different length and means responsive to said different length pulses for producing said fourth signal.

12. A bill acceptor as in claim 5 in which said scanning means is adapted to produce a fifth signal in response to the presence of magnetic material in a third region of said bill, said acceptor including means for producing a sixth signal corresponding in time to the presence of said third region adjacent to said scanning means, said means responsive to the concomitant absence of said first signal and presence of said third signal being similarly responsive to said fifth and sixth signals.

13. A bill acceptor as in claim 12 in which said receiving means comprises means forming a passage having an entrance, said acceptor including means for producing a seventh signal in response to introduction of a bill into said passage through said entrance, and means responsive to the concomitant presence of said sixth and seventh signals for producing a third spurious bill signal.

14. A bill acceptor as in claim 5 in which said receiving means comprises means forming a passage having an entrance and an exit, said scanning means comprising a magnetic sensing head located along said passage and means for moving said bill along said passage past said head in a direction from said entrance to said exit, said acceptor including means responsive to introduction of a bill into said passage through said entrance for producing a fifth signal, means responsive to the arrival of the leading edge of a bill at a predetermined point along said passage for producing a sixth signal and means responsive to the concomitant presence of said fourth and fifth signals for producing a spurious bill signal.

* * * * *

Disclaimer 3,966,047.—*Larry E. Steiner*, Grand Rapids, Mich. PAPER CURRENCY ACCEPTOR. Patent dated June 29, 1976. Disclaimer filed Feb. 25, 1977, by the assignee, *Rowe International, Inc.*

Hereby enters this disclaimer to claims 1 to 9 of said patent.

[*Official Gazette May 3, 1977.*]